United States Patent [19]

Brown

[11] 4,146,216

[45] Mar. 27, 1979

[54] COMBINED COLLATOR-SORTER

[75] Inventor: Michael A. Brown, Norwalk, Conn.

[73] Assignee: Pitney-Bowes, Inc., Stamford, Conn.

[21] Appl. No.: 790,492

[22] Filed: Apr. 25, 1977

[51] Int. Cl.[2] ..... B65H 39/05

[52] U.S. Cl. ..... 270/58

[58] Field of Search ..... 270/58, 52; 271/64, 271/173

[56] References Cited

U.S. PATENT DOCUMENTS

| | | | |
|---|---|---|---|
| 3,708,160 | 1/1973 | Kantarian | 270/53 |
| 3,871,643 | 3/1975 | Kukucka | 271/173 |

*Primary Examiner*—Edgar S. Burr
*Assistant Examiner*—A. Heinz
*Attorney, Agent, or Firm*—Martin D. Wittstein; William D. Soltow, Jr.; Albert W. Scribner

[57] ABSTRACT

A sheet handling machine having the dual capability of either collating or sorting sheet material into individual booklets or collations. The machine has a plurality of sheet receiving bins operatively associated with infeed and outfeed locations of the machine, and a conveyor system for moving sheets between the infeed and outfeed locations in a predetermined sequence. The machine includes movable deflectors for deflecting sheets from the conveyor means into the bins, and feeding means located in the bins for feeding sheets from the bins back into the conveyor system. Appropriate controls are provided to cause the deflecting means or the feeding means to be selectively operable in a predetermined sequence. In a sorting mode of operation, successive copies of the first page of a booklet are fed into successive bins until each bin contains one copy. Thereafter, successive copies of each successive page of the booklet are fed into each bin until each bin contains a completed booklet. Thus, as many booklets are simultaneously formed as there are bins. In the collating mode, each bin is automatically loaded with a predetermined number of the same page of the booklet, and a single sheet from each bin is ejected and conveyed to a receiving station to form a single completed booklet.

5 Claims, 13 Drawing Figures

| LINE | INPUTS | | | OUTPUTS | | | |
|---|---|---|---|---|---|---|---|
| | A | B | C | W | X | Y | Z |
| 1 | 0 | 0 | 0 | 0 | 0 | 0 | 0 |
| 2 | 0 | 0 | 1 | 0 | 0 | 0 | 1 |
| 3 | 0 | 1 | 0 | 0 | 0 | 0 | 0 |
| 4 | 0 | 1 | 1 | 0 | 1 | 0 | 1 |
| 5 | 1 | 0 | 0 | 0 | 0 | 0 | 0 |
| 6 | 1 | 0 | 1 | 1 | 0 | 0 | 0 |
| 7 | 1 | 1 | 0 | 0 | 0 | 0 | 0 |
| 8 | 1 | 1 | 1 | 1 | 1 | 1 | 0 |

| INPUT | OUTPUT |
|---|---|
| BCD 10 AND UNDER | 1 |
| BCD 11 AND OVER | 0 |

COMBINED COLLATOR-SORTER

BACKGROUND OF THE INVENTION

1. Field of the Invention

The arts of sheet collating and sorting are well known arts that have been practiced for a very long time. A vast amount of technology has been developed, and many machines have been designed for arranging sheets of paper in a predetermined orderly fashion. With the development of fully automatic high speed printing machines, and the more recent advent of high speed copying and/or duplicating machines, there has been a steadily increasing demand for collating and sorting machines which are compatible with the large variety of printing, copying or duplicating machines presently available.

In order to better understand the development of the prior art in the above field, as well as the existing necessity for the present invention, one should have a basic understanding of the distinction between sorting and collating even though these terms have not been universally accepted as designations for the respective sheet handling methods hereinafter described. Generally speaking, in a machine in which a predetermined number of bins are to be utilized, the term sorting designates a method of sheet handling in which a plurality of successively identical sheets are fed into the predetermined number of bins until each bin contains one sheet, for example, page 1 of a twenty page booklet. Thereafter, another plurality of successively identical sheets are fed into the bins until each bin contains one of the second plurality of sheets, for example, page 2 of the twenty page booklet. This method of loading the bins is continued until each bin contains one copy of each of the twenty pages of the booklet in sequential order, so that at the end of the operation each bin contains a completed booklet. If ten bins are utilized, ten booklets will be simultaneously formed each having twenty sheets. Typically, in prior art sorting machines, notwithstanding the advantage of the sorting machine having on-line capability with a copying or duplicating machine, the completed booklets or collations must be removed at this time from the machine by hand, and the pages of each booklet are fastened together by any suitable means. Such means include conventional stapling, either by a manual operation or by feeding the booklet into an automatic jogging and stapling machine of which a variety of such machines are commercially available.

In the method of collating, a machine having a plurality of bins is preloaded with a predetermined number of identical sheets. After the bins have been loaded, a feeding means asociated with each bin, ejects one sheet at a time from each bin in order to form a collation (booklet) containing the desired number of sheets. In this mode of operation, each collation is formed individually, rather than all collations formed simultaneously. This is because the sheets are ejected from the bins in the same order as the numerical order of the pages that form the collation for each cycle of operation of the machine. Thus, for example, if it is desired to generate fifty booklets each having ten pages, each of ten bins is preloaded with fifty copies of a page of the booklet. The feeding means associated with each bin then operates to eject the ten pages, either simultaneously or successively, so that during one operating cycle of the machine, ten pages in numerical order are delivered to a receiving station. Thus, the fifty booklets are formed by running the machine through fifty cycles of operation in the above manner.

Notwithstanding the disadvantage of the requirement for hand loading typical prior art collating machines, one of the advantages of these prior art collating machines was the capability of automatically finishing each booklet as it is formed by placing any of a variety of stapling or stitching machines which are commercially available on-line with the collator.

It will thus be seen that the sorting technique is most efficiently utilized when it is desired to generate a small number of booklets each having a large number of pages, whereas the collating technique is most efficiently utilized when it is desired to generate a large number of booklets each having a small number of pages.

Another convenient way of easily recognizing the distinction between sorting and collating is to consider that in sorting the number of bins equals the number of booklets which can be formed regardless of the number of pages, and in collating the number of bins equals the number of pages in each booklet regardless of the number of booklets which are being formed.

In the methods described above, the sorting and collating machines are each illustratively chosen to have 10 bins available to hold 50 sheets of paper. With a sorting machine, the sorting technique would be selected to form a maximum of 10 booklets of 50 pages each. With a collating machine, the collating technique would be used to form a maximum of 50 booklets each having 10 pages.

Statistical anaylsis from typical in-plant duplicating rooms, commercial print shops, quick copy centers and other facilities in which a large volume of copying is carried out, reveals that the above chosen number of booklets and pages is representative of the vast bulk of individual operations carried out in the copying and duplicating field. This indicates that the prior art should have developed along the lines of a large variety of sorting and collating machines in the 10 bin range, or perhaps in the 10 to 20 bin range. Although some sorting and most collating machines have a number of bins within this range, the development of the prior art, and the commercial availability of products, has been directed more towards machines having large numbers of bins, particlarly so in the case of sorting machines. These machines are, of course, very complex in construction and operation, and highly sophisticated in the manner in which they can be programmed to generate multiples of booklets in a single operating cycle. They are also extremely expensive. All of these factors tend to make these machines attractive only to operators of very large commercial duplicating centers, or to print shops which handle extremely large volume jobs, e.g. 100 or more pages per booklet for a collating operation or many thousands of booklets having a relatively small number of pages for a sorting operation. The result of this situation, is that the average user of sorting and collating machines does not have freedom of choice to choose tthe best method of paper handling conducive to the size and number of booklets which he desires to form. The user must of necessity purchase both a sorting machine and a collating machine from such machines commercially available in the 10 to 20 bin range, or he must purchase either a larger collating machine or a larger sorting machine and use either machine efficiently for only one type of booklet formation and very inefficiently for the other type of booklet formation for which it wasn't designed. His only other choice is to farm out his sorting and/or collating jobs to outside print shops which can afford to maintain the necessary number and size of machines to handle all types of jobs. Of course, all of the aforementioned alternatives result in the individual paying a higher per unit cost for smaller jobs.

The present invention, as will be more fully appreciated hereinafter, is directed to the provision of a combined sorting and collating machine. The invention provides the capability of performing both of the above described sheet handling methods in a single machine, whose bin capacity is within the above enunciated range most suitable for the average user of sorting and collating equipment. The combined sorting and collating machine of the present invention will handle any sorting job in which the number of booklets to be formed is limited to the number of bins available (the number of pages per booklet being limited only by the sheet capacity of the bins). The machine will also handle any collating job in which the number of pages in each booklet is limited to the number of bins in the machine (the number of booklets which can be formed being limited only by the sheet capacity of each bin). It will be apparent that the machine of the present invention will meet all of the sorting and collating requirements of users within the range statistically determined to cover the vast bulk of such users.

Another advantage with this type of machine is that if machine is constructed with relatively large bins, it can be used in a sorting mode to form booklets having an extremely large number of pages, and can be used in a collating mode to form an extremely large number of booklets. This advantage is helpful for those occasional situations where a sorting or collating run extends beyond the range of a normal (average) run.

A still further significant advantage of the combined sorting and collating machine of the present invention is its capability of automatically loading sheets for the collating mode. The machine is operated in a semi-sorting mode in which identical sheets are loaded into the same bin, and successions of subsequent sheets are each loaded into respective successive bins. The resulting procedure provides an automatic loading of the machine which will thereafter be operated in a collating mode.

2. Prior Art

As previously mentioned, there are a few machines in the prior art which have a number of bins within the range of the number of bins in the machine of the present invention. One such machine is disclosed in U.S. Pat. Nos. 3,580,563 and 3,773,313, both issued to Ernest D. Bassett on May 25, 1971 and Nov. 20, 1973, respectively. These patents disclose a collator having a horizontal array of substantially vertically opening bins. Feeding means associated with each bin eject individual sheets from a stack of sheets contained in each bin, for the purpose of forming a collation of ejected sheets. Thus, by the definitions given above, this machine is a collator. The machine also includes a relatively complicated system of manually adjustable baffles which, in cooperation with a sheet conveyor, function to feed sheets from the conveyor into the individual bins. When the conveyor is run in a reverse direction from the direction in which it is run during normal collating, the bins of the machine can be automatically loaded prior to performing a collating operation. Thus, the machine disclosed in these patents is essentially an automatically loading collator.

The significant deficiency of the machine disclosed in these patents, and therefore the significant distinction between the machine of the present invention and that disclosed in the patents, is that no provision whatever is made for operating the prior art machine in a sorting mode. The Bassett machine is devoid of any concept or structure which would allow, or even facilitate with modification, the sorting operation to be carried out in this machine.

Another significant deficiency in the Bassett machine is that the only provision for ingress and egress of sheets to and from the machine is at one end thereof, which renders it particularly difficult to use the machine on-line with a copying or duplicating machine. As previously described, a significant advantage of any sorting machine is that it can be used on-line with a copying or duplicating machine, so as to sort the successive copies of the same document into different bins, and repeat the operation with successive documents. In sharp contrast to this deficiency, the machine of the present invention, at least in the preferred embodiment, provides for ingress of sheets at one end of the machine and egress of sheets at the other end, so that the machine can be operated on-line with a copier or duplicator. The inventive machine can thereby perform a sorting function in a most efficient manner. A corollary advantage of this construction over Bassett, is that by appropriate manipulation of the baffles and baffle controls which operate one way in a sorting mode operation, the machine of the present invention can also be operated to automatically load the bins preparatory to a collating operation. This is in lieu of manually loading the bins prior to the collating operation.

Thus, the machine of the present invention is so designed and constructed to perform functions neither contemplated nor possible with the prior art machine. The machine of the present invention also performs the same functions as those of the prior art machine with much less complicated structure, and in a more efficient manner. The invention achieves this, while at the same time achieving greater versatility and having provisions for automatic changeover from one mode of operation to another. This the prior art machine cannot accomplish.

SUMMARY OF THE INVENTION

The present invention relates generally to a sheet handling apparatus, and more particularly to a combined sorting and collating machine which can be operated selectively to organize printed sheet material by either sorting or collating techniques.

The sorting and collating machine generally comprises a means defining a sheet infeed location and a sheet outfeed location. Operatively associated with these locations is a plurality of adjacent sheet receiving and storing bins. A conveyor means is operatively associated with the plurality of bins, for conveying sheets seriatim from the infeed location to the plurality of bins, and for conveying sheets from the plurality of bins to the outfeed location. In one embodiment of the invention, a movable sheet deflecting means is disclosed between the conveyor means and the bins for deflecting sheets from the conveyor into the bins. A sheet feeding means is operatively associated with each of the bins for ejecting sheets from the bins to the conveyor means for delivery of the ejected sheets to the outfeed location of the machine.

The machine includes a first control means for actuating the sheet deflecting means in such a manner as to cause the sheet deflecting means to deflect successive sheets from the conveyor means into a preselected one or more of the plurality of bins. A second control means is provided for actuating the sheet feeding means to cause the sheet feeding means to eject sheets in a selectable succession from the bins to the conveyor means. There is also a selector means operatively associated with both the first and second control means in order to be able to select which of the first or second control means is operable in order to respectively control the deflector means and/or the sheet feeding means in a desired mode of operation for the machine.

In the preferred embodiments of the invention, the plurality of sheet receiving and storing bins are arranged as a substantially vertical array of substantially horizontally oriented, adjacent bins. The conveyor means is in the form of a conveyor belt disposed adjacent the vertical array of bins. In one form of the invention there is a first conveyor belt extending from the infeed end of the machine along the vertical array of bins, and a second conveyor belt disposed adjacent the vertical array of bins at another end of the bins. The sheets are fed into the bins from one end, and are fed out of the bins at the other end. The deflector means is in the form of individual deflectors mounted adjacent the infeed end of each bin, and are sequentially operated to deflect sheets into successive bins. The sheet feeding means is preferably in the form of individually operable roller feeding devices, or sheet pushing devices mounted within each bin. Each is individually operable to eject sheets from the bins in a preselected order.

Having briefly described the general nature of the present invention, it is a principal object thereof to provide a combined sorting and collating machine.

It is another principal object of the invention to provide a combined collating and sorting machine that will automatically load sheets preparatory to operating the machine in a collating mode.

It is another object of this invention to provide a combined collating and sorting machine which the sheet conveying and storing components are arranged to facilitate the collating and storing machine being placed on line with one or both of a duplicating machine and a set finishing machine.

It is another object of this invention to provide a combined collating and sorting machine which provides for automatic unloading of stacks of sheets from the storage bins after completion of a sorting operation so that the stacks of sheets can be fed directly to a set finishing machine.

It is another object of this invention to provide a combined collating and sorting machine in which the same sheet deflecting elements are utilized for both sorting and automatic loading preparator to collating and which utilizes electronic controls to cause operation of the machine in a preselected mode of operation.

It is another object of this invention to provide a combined collating and sorting machine which is relatively simple in construction, is easy to operate and maintain and provides greater flexibility than heretofore possible with prior art collating machine or sorting machines.

These, and many other objects of this invention, will become more apparent and will be better understood with reference to the following detailed description taken in conjunction with the accompanying drawings, in which:

FIG. 1 shows the ingress of sheet material into the combined collating and sorting machine, and FIG. 2 depicts the egress of sheet material from the combined collating and sorting machine;

FIG. 4 depicts the ingress of loading of the trays of the inventive apparatus with sheet material, and FIG. 5 shows the egress or ejection of the sheet material from the trays of the inventive machine;

Figure 9:
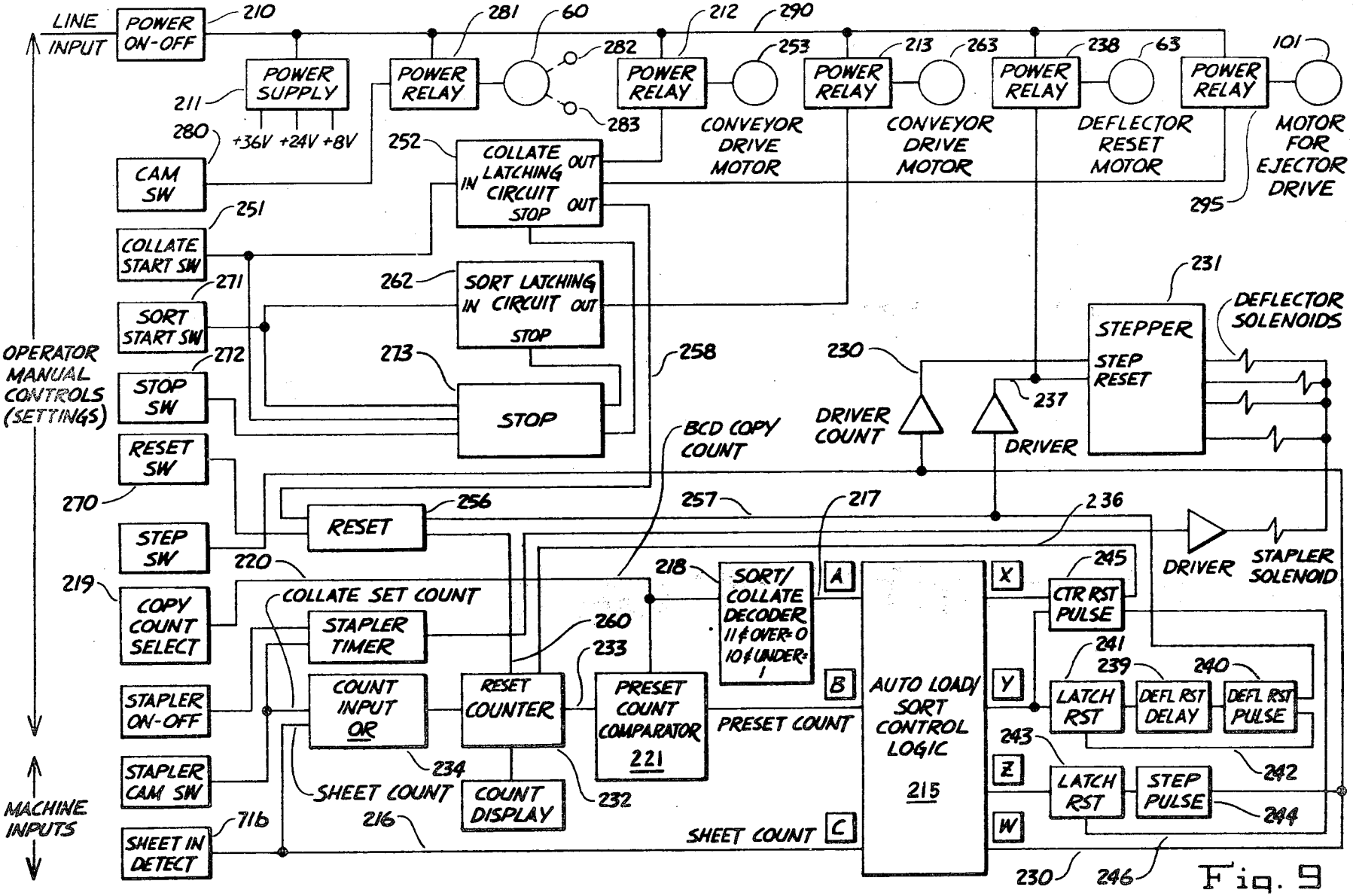
FIG. 9 is an electrical diagram of the control circuitry for the embodiment shown in FIG. 6.
Figures 9A, 9B:
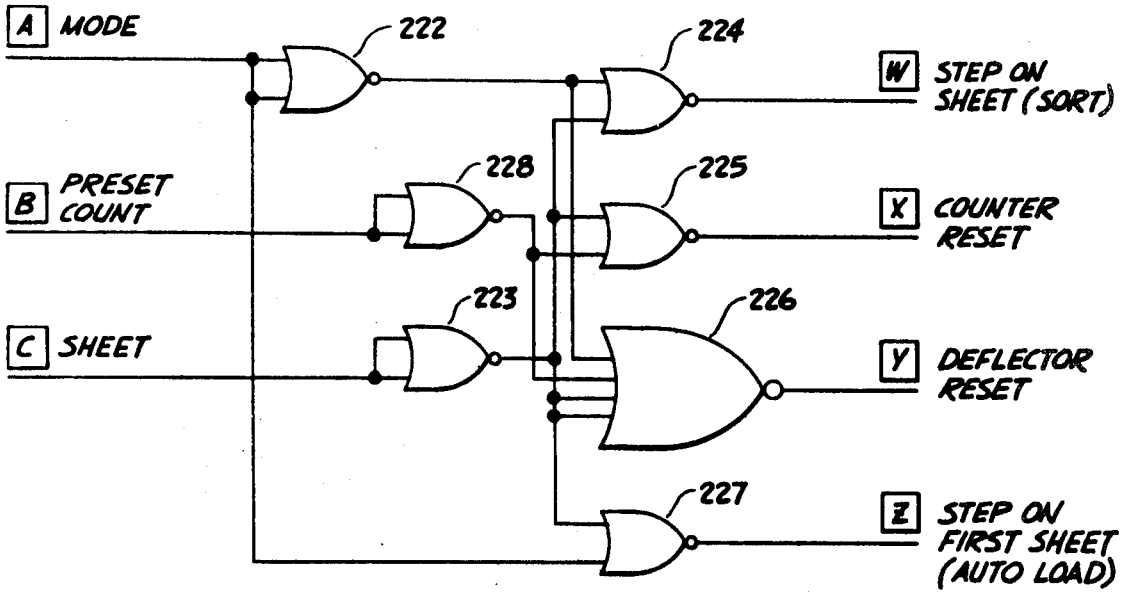

FIG. **9*a* is a detailed electrical schematic of the auto load/sort control logic depicted in FIG. 9**;

FIG. **9*b* is a truth table for the auto load/sort control logic depicted in FIG. 9*a*;**

Figures 9C, 9D:
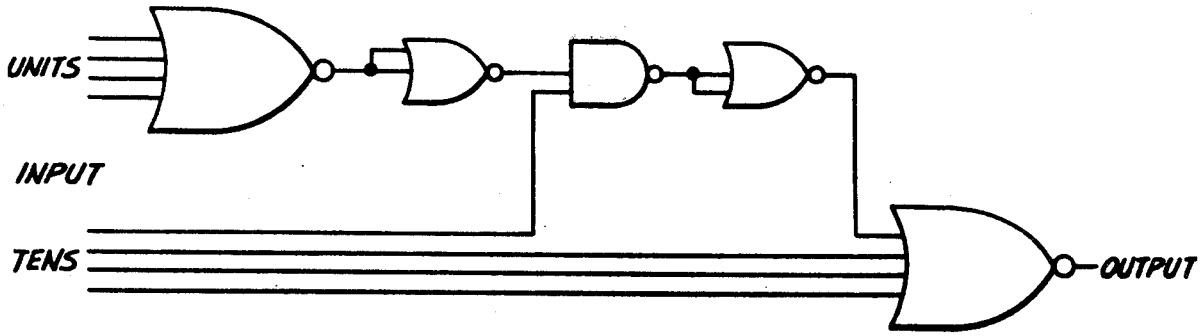

FIG. **9*c* is a schematic view of the sort/collate decoder circuit illustrated in FIG. 9; and FIG. 9*d* is a truth table for the sort/collate decoder circuit depicted in FIG. 9*c*.**

Figure 1:
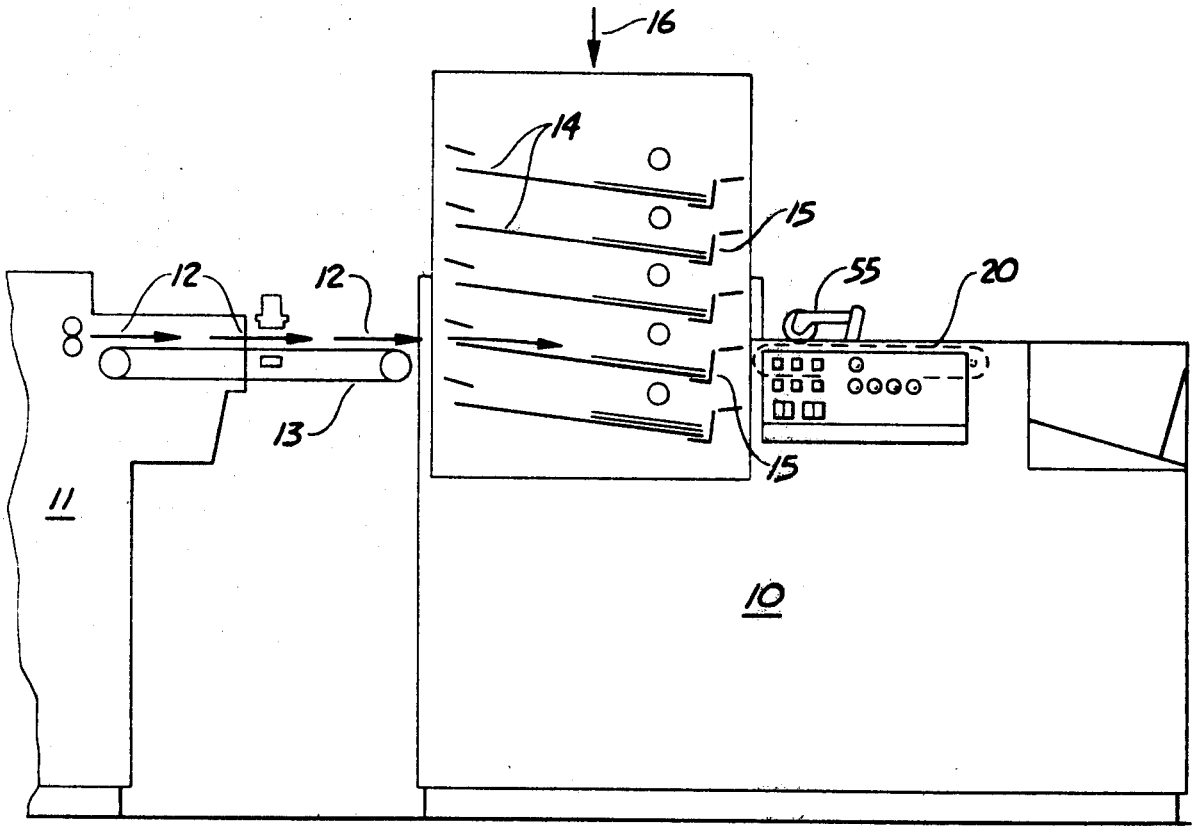
FIGS. 1 and 2 are schematic side views of the inventive apparatus.
Figure 2:
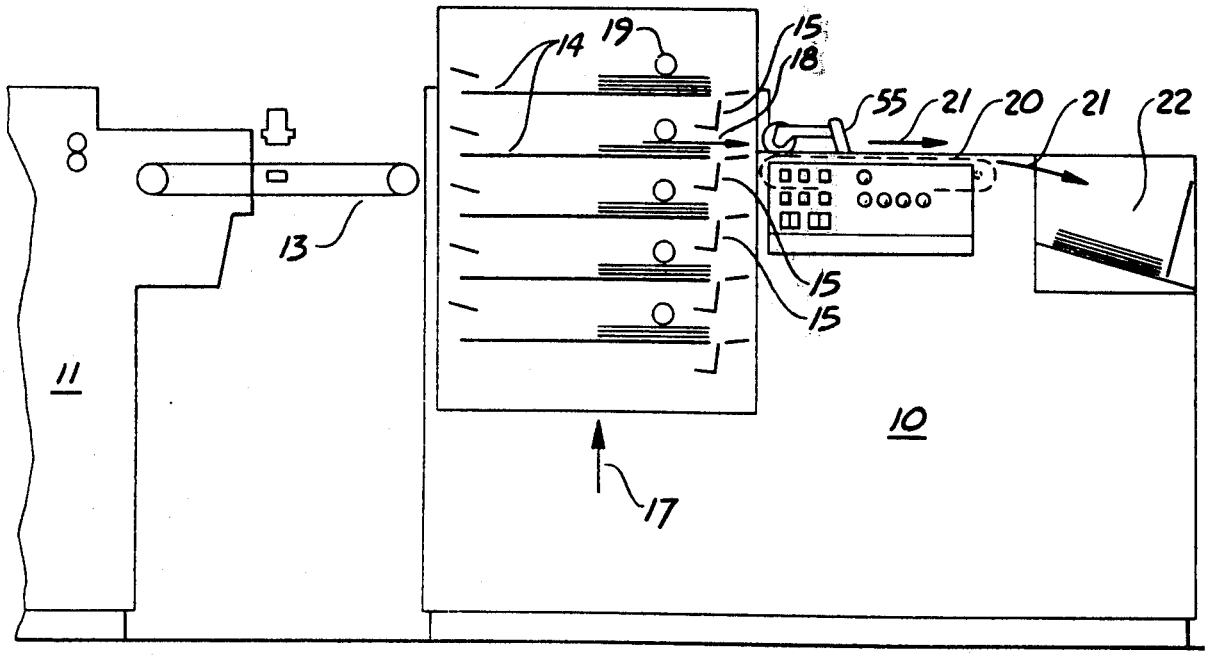

Referring now to FIGS. 1 and 2, the combined collating and sorting machine of this invention is first schematically shown in a sheet receiving or sorting mode, and then respectively in a collating mode. The combined collating and sorting machine 10 will be referred to hereinafter as a "COLLATOR-SORTER", for the sake of brevity. The collator-sorter receives sheets of printed material from a printer or copier machine 11. The sheets are conveyed (arrows 12) from the copier machine 11, via a conveying belt 13, to individual trays or bins 14 of an array of bins of the collasorter 10. The trays 14 are disposed in an inclined position such that the incoming sheets are gravitationally biased against a backstop or abutment 15 disposed adjacent each tray 14.

The bins 14 are caused to be incrementally indexed (arrow 16) past the conveyor 13, such that each bin or tray 14 can be filled, if so desired.

In FIG. 2, the sheets are being typically ejected (arrow 18) from a bin 14 by a frictional roller 19. The sheets are then fed to a bite of a takeaway or transporting conveyor 20 or other suitable conveyor device. The takeaway roller 20 projects (arrows 21) the sheets into a finishing apparatus or stacking bin 22.

The trays 14 are pivoted to a horizontal position in order to eject the sheets. This serves two purposes: (a) the sheets are caused to clear abutments 15; and (b) the sheets are brought into biased contact with the friction roller 19.

The array of bins are caused to incrementally move (arrow 17) past the transporting conveyor 20, one bin at a time, during the collating sequence. When all the bins 14 have been traversed, the array of bins is returned to its initial or start position, and the bins are again downwardly indexed past the conveyor 20.

Figure 3:
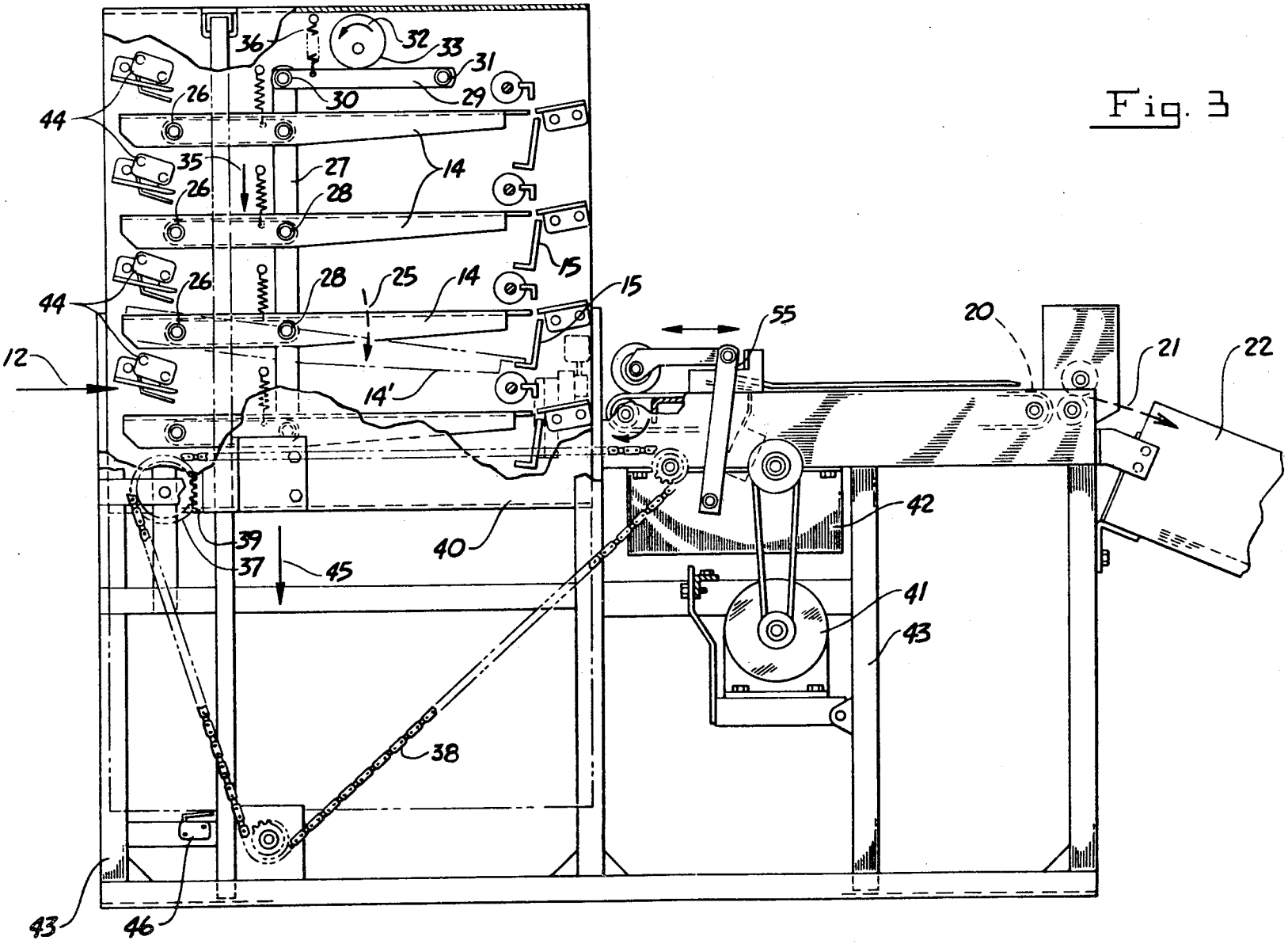
FIG. 3 is a more detailed side view of the invention of FIGS. 1 and 2.
Figure 5:
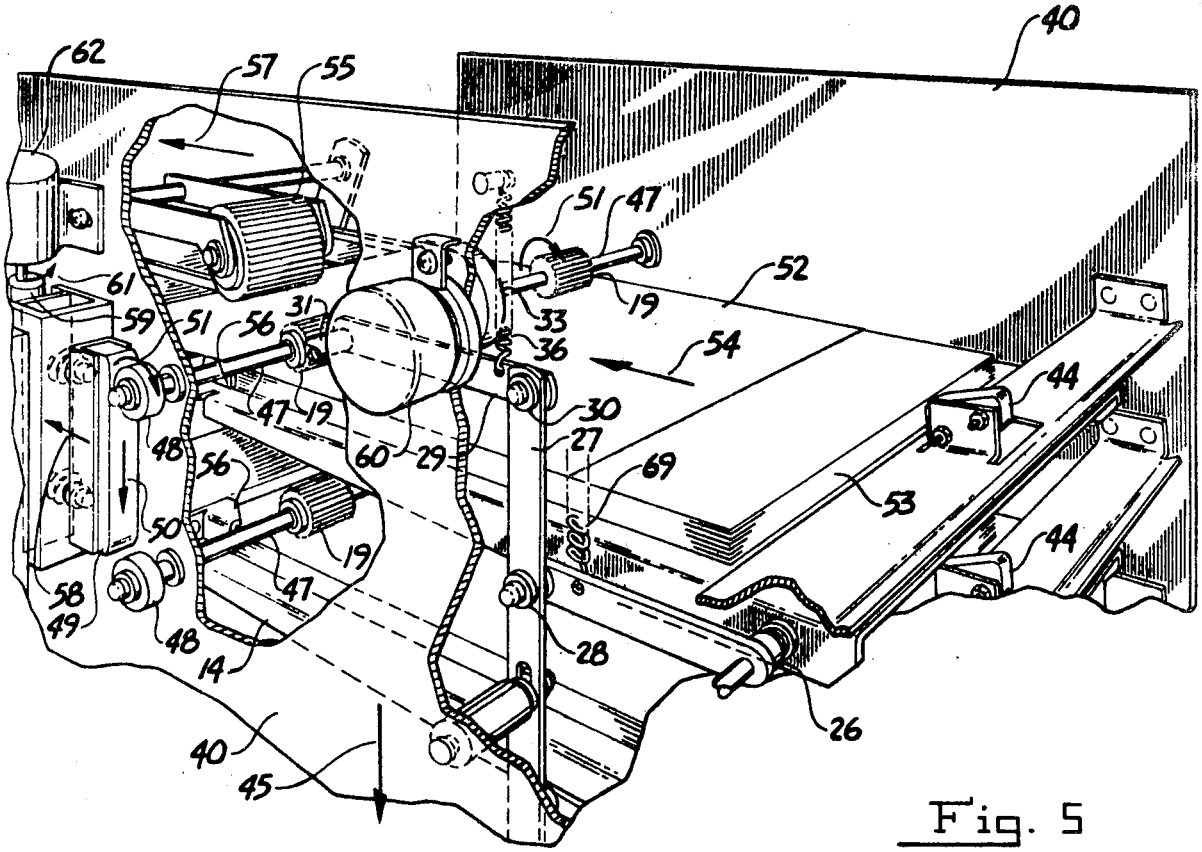
FIGS. 4 and 5 are perspective views of a portion of the machine illustrated in FIG. 3.
Figure 4:
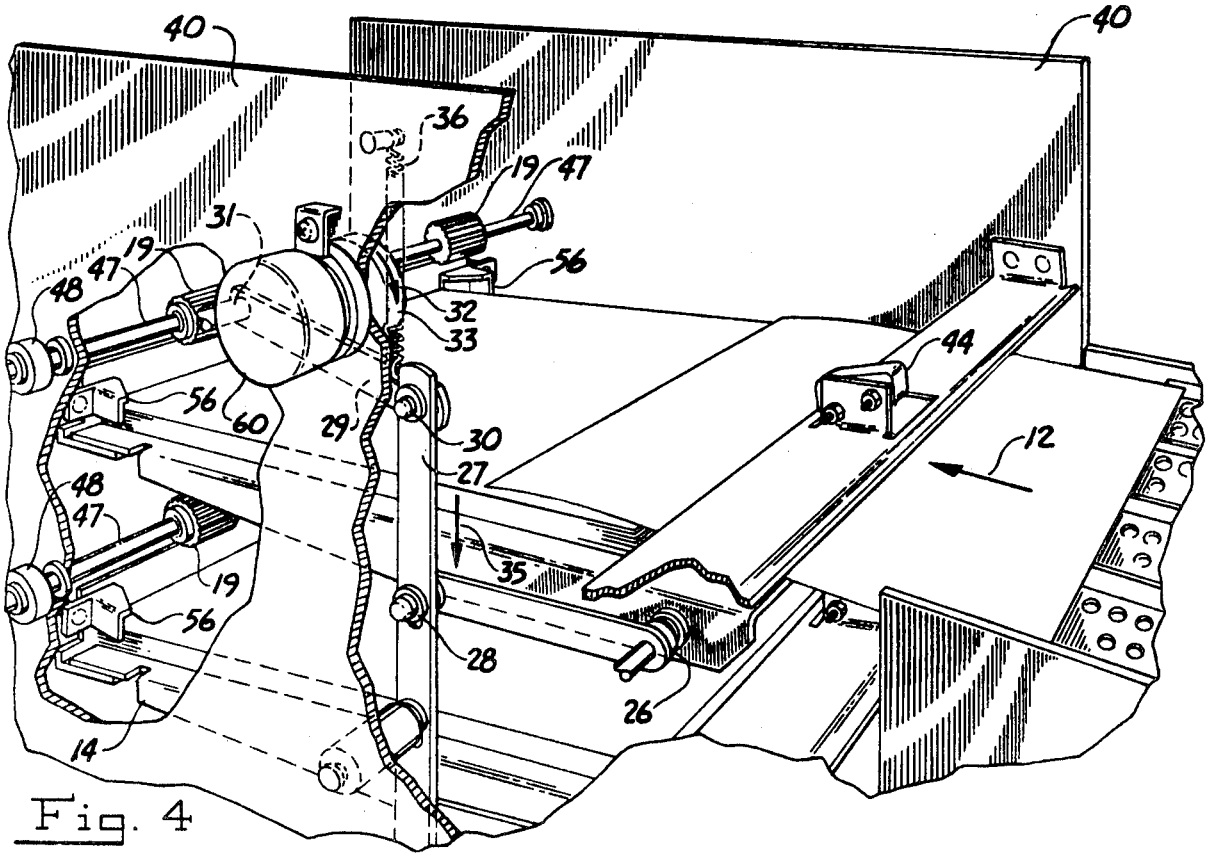

Referring to FIGS. 3, 4 and 5, the collator-sorter 10 of FIGS. 1 and 2 is shown in greater detail. Incoming sheets (arrow 12) are individually deposited in respective bins 14 (FIGS. 3 and 4). The bins 14 will all be pivoted (arrow 25) to an inclined position as typically shown by the phantom bin 14' (FIG. 3). The bins 14 are each pivoted about a pivot 26. A rod 27 is pivotably attached to each tray 14 at point 28 by a pin or other suitable means. The rod 27 is pivotably attached to pivot arm 29 via a pivot pin 30. Arm 29 is caused to pivot about pivot 31 via a rotating (arrow 32) cam 33 as shown. The cam 33 is driven by a stepper motor 60 through 180 degrees. The rod 27 is caused to move downwardly (arrow 35) via the movement arm 29 and cam 33, thus causing each tray 14 to pivot about point 26. This will result in providing each tray with a sheet receiving incline, as aforementioned.

The rod 29 is biased to a home position by a spring 36, in order to return the trays 14 to a horizontal position when cam 33 is returned to its starting point (rotated another 180 degrees).

The array of bins are incrementally driven downwardly (arrow 45) by a rack and pinion mechanism; the pinion of which is rotatively fixed to the sprocket wheel 37, which is driven by the chain 38. The rack 39 of the aforementioned rack and pinion mechanism is affixed to the housing 40 of the bin array. Thus, as the chain 38 drives the sprocket wheel 37, the pinion (not shown) affixed to wheel 37 will move the rack 39 downwardly, and hence, the bin array. The chain 38 is reversibly driven to a starting position at the end of each page run. A motor 41 and a transmission 42 drives the sprocket chain drive. The motor 41 is secured to the frame 43 of the collator-sorter 10.

Sheets entering each bin are counted by means of a microswitch 44 disposed at the mouth of each bin. A photodetector can also be used to this purpose.

A limit switch 46 connected to frame 43 senses the (downward travel) end position of the bin array housing 40, in order to return the array to the start position.

When the sheets are to be ejected, the trays 14 assume a horizontal position as illustrated in FIGS. 2 and 3.

The ejection of the sheets will be explained with reference to FIG. 5.

The sheet ejecting roller(s) 19 are affixed to shaft 47, which is rotatably secured in the walls of the bin array housing 40. On the near end of shaft 47 is affixedly secured a friction roller 48. As the housing 40 is incrementally indexed downwardly (arrow 45), the roller 48 comes in contact with a spring-loaded friction shoe 49. The roller 48 is caused to rotate in a clockwise manner (arrow S1) as it frictionally engages the shoe and moves downwardly (arrow 50) over the surface of show 49. This in turn causes the shaft 47 and the affixed ejecting rollers 19 to also rotate in a clockwise manner (arrow 51). A stack of sheets 53 is positioned under rollers 19. The tray 14 and the sheets are biased upwardly by a typical spring 69 (FIG. 5), such that the sheets 53 press against the rollers 19. When rollers 19 are caused to turn (arrow 51), the top sheet 52 of the stack 53 is drawn off (arrow 54) from the stack 53.

Only one sheet 52 is fed off the top of stack 53 by means of corner separators 56, which are well known separating devices in this art.

Each top sheet 52 is ejected to a waiting reciprocating pressure roller mechanism 55, which pulls (arrow 57) sheet 52 onto a conveyor 20 (see FIGS. 1-3). The reciprocating pressure roller mechanism 35 is constructed and functions as shown in the patent to: L. Mestre; U.S. Pat. No. 3,004,758; issued: Oct. 17, 1961.

In order that the friction shoe 49 does not interfere with rollers 48 on the uptake, i.e. when the housing 40 is moved upwardly to its start position, the shoe 49 is withdrawn in the direction of arrow 58. This is accomplished by means of the cam 59, which is rotatively driven (arrow 61) by stepper motor 62.

The shoe 49 is also disengaged (arrow 58) during the loading of trays 14 as depicted in FIGS. 1 and 4.

Figure 6:
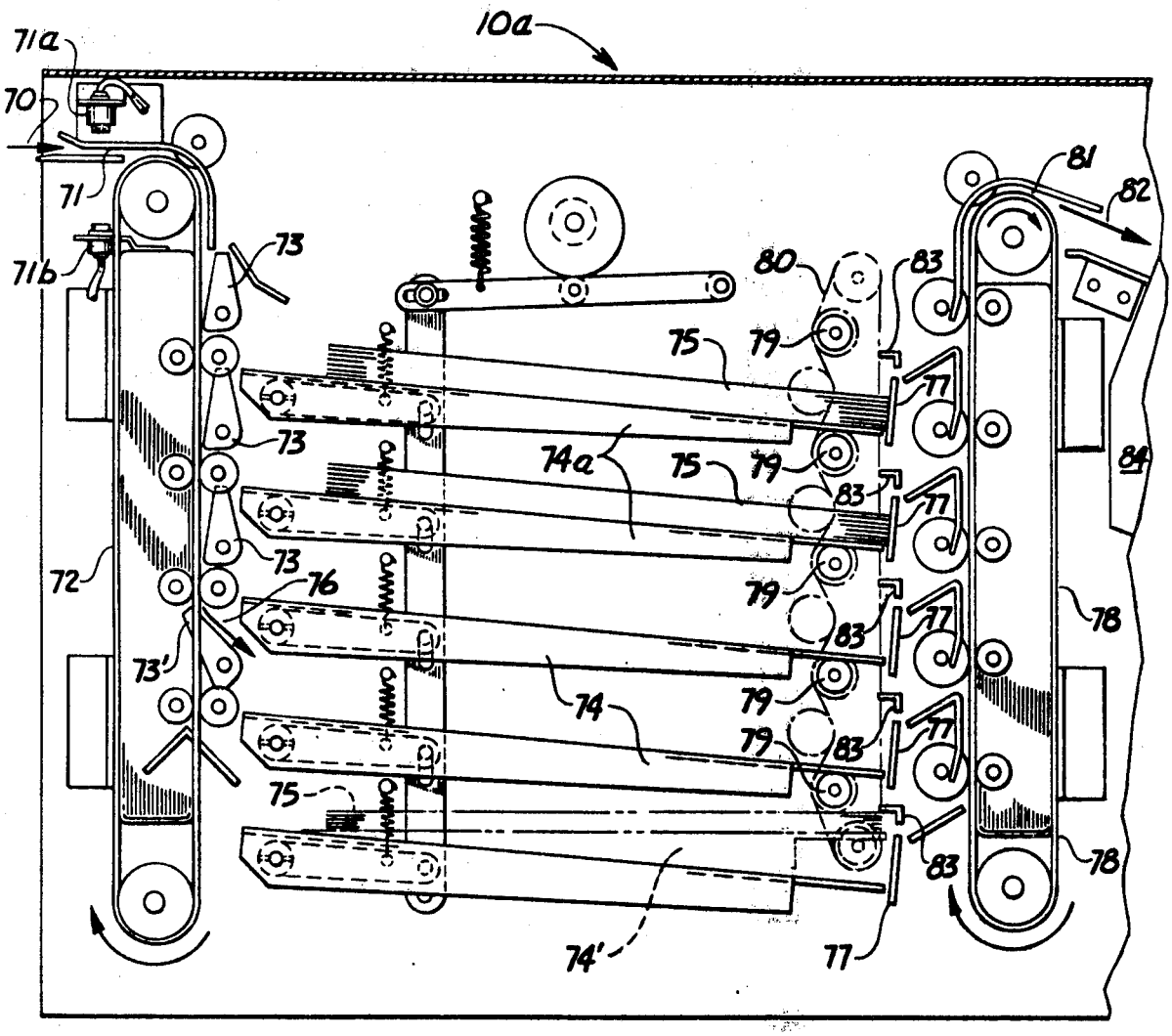
FIG. 6 is a side view illustrating an alternate embodiment of the invention depicted in FIGS. 1–3.
Figure 7:
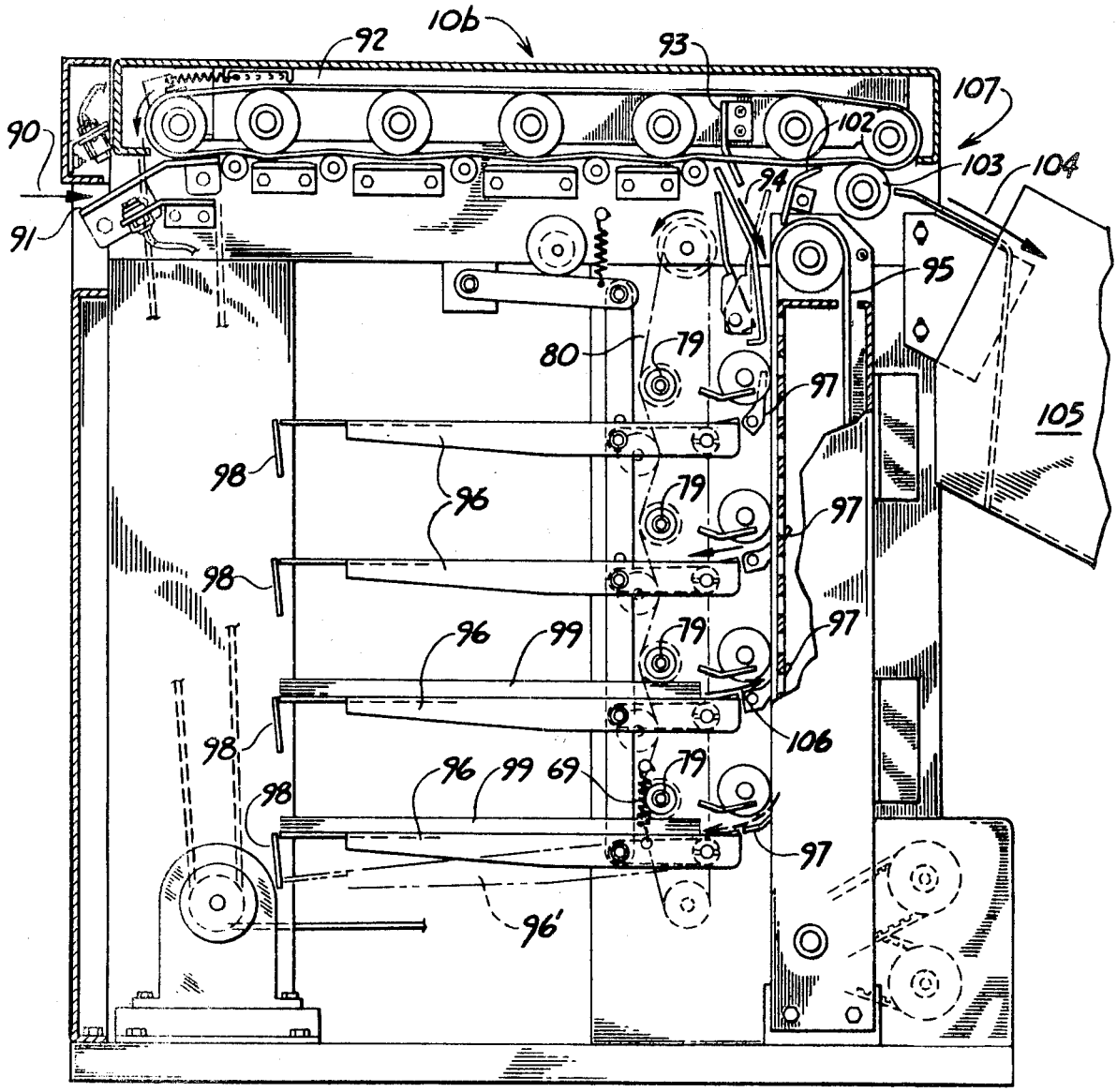
FIG. 7 is a side view of still another alternate embodiment of the invention depicted in FIGS. 1–3.

FIGS. 6 and 7 illustrate two other embodiments of the collator-sorter 10 shown in FIGS. 1-5. These embodiments depict a collator-sorter having a stationary housing, i.e. the housing is not indexed past a fixed ingress or egress location. Rather, the new collator-sorter embodiments feature a fixed housing with a substantially stationary array of bins.

Referring to FIG. 6, the collator-sorter 10*a* receives sheets (arrow 70) at an infeed location 71. A conveyor 72 carries the received sheets past an array of bins or trays 74. Opposite or adjacent each tray is a pivotably controlled deflector member 73. The deflector member 73' is shown in a pivoted position for allowing sheets to be deposited (arrow 70) from the conveyor 72 into its adjacent tray 74. Trays 74*a* contain a stack of sheets 75, which have been already deposited therein. In the loading mode, the trays 74 are slightly inclined, similar to the previous embodiment 10. Thus, the sheets come to rest against the abutment member 77.

The trays 74 assume a more horizontal orientation when the sheets are to be ejected to the take-away conveyor belt 78. Position 74' illustrates in phantom a tray in the typical horizontal ejection position for all the trays.

All the trays are pivotably controlled by the same kind of cam and pivot rod arrangement as depicted in the prior embodiment. The pivot arrangement will not be described again for the sake of brevity.

When the sheets are to be ejected from the bins (trays), the trays assume the horizontal position, and each stack of sheets 75 come in contact with a respective ejection roller 79. The ejection rollers 79 are all driven by a common drive belt system 80. Each roller 79 has an over-running clutch, so that when the ejected sheet is picked up by the conveyor belt 78, the sheet can be pulled from the bite of rollers 79 without difficulty. The ejected sheets are conveyed by conveyor 78 to the outfeed end 81 of the machine, and are then discharged (arrow 82) to a stacker 84 or finishing apparatus. Only the top sheet of each stack 75 is fed due to the corner separators 83, which prevent multiples from being discharged from the trays.

The ejection apparatus will be explained in greater detail hereinafter with reference to FIG. 8.

FIG. 7 illustrates still another embodiment of the invention, and is designated collator-sorter 10*b*. An incoming sheet (arrow 90) is fed to the infeed end 91 of the collator-sorter, where it is picked up by the conveyor 92. The sheet is carried by the conveyor 92 until it strikes a fixed deflector 93, and is directed downwardly (arrow 94) to a second conveyor belt 95.

The sheet is transported by conveyor 95 to each tray 96. The deflectors 97 direct the sheet material into each bin (tray), and are operative in like manner as is shown in FIG. 6. The controls for operating the deflectors 97 (FIG. 7) and the deflectors 73 (FIG. 6), respectively, are shown and described in copending application Ser. No. 790,348; filed herewith.

The bottom tray of the array is shown in phantom in an inclined sheet receiving position designated 96'. As in the prior embodiment 10*a*, the sheets of this embodiment are also stacked against an abutment member 98.

When the sheets are to be ejected, the trays 96 are returned to a horizontal poisition by the previously described cam and rod mechanism. The typical spring 69 (each tray is spring loaded) biases each stack of sheets 99 against the ejection friction roller 79. The sheets are ejected one at a time from each tray 96, by ejection rollers 79 similar to the collator-sorter 10*a* of FIG. 6. As before, each ejection roller 79 is driven by a common drive belt mechanism 80.

When the sheets are ejected (arrow 10*b*), the conveyor 95 is driven in a clockwise manner, vis-a-vis the counterclockwise direction when loading the trays. The sheets are conveyed to a guide 102, which directs the sheets into the outfeed bite between roller 103 and the conveying belt 92. The sheets are discharged (arrow 104) from the outfeed end 107 into a stacker 105 or other appropriate finishing device.

As explained before, only one sheet from every tray will be fed with each ejection roller cycle due to the corner separators (not shown in FIG. 7).

Figure 8:
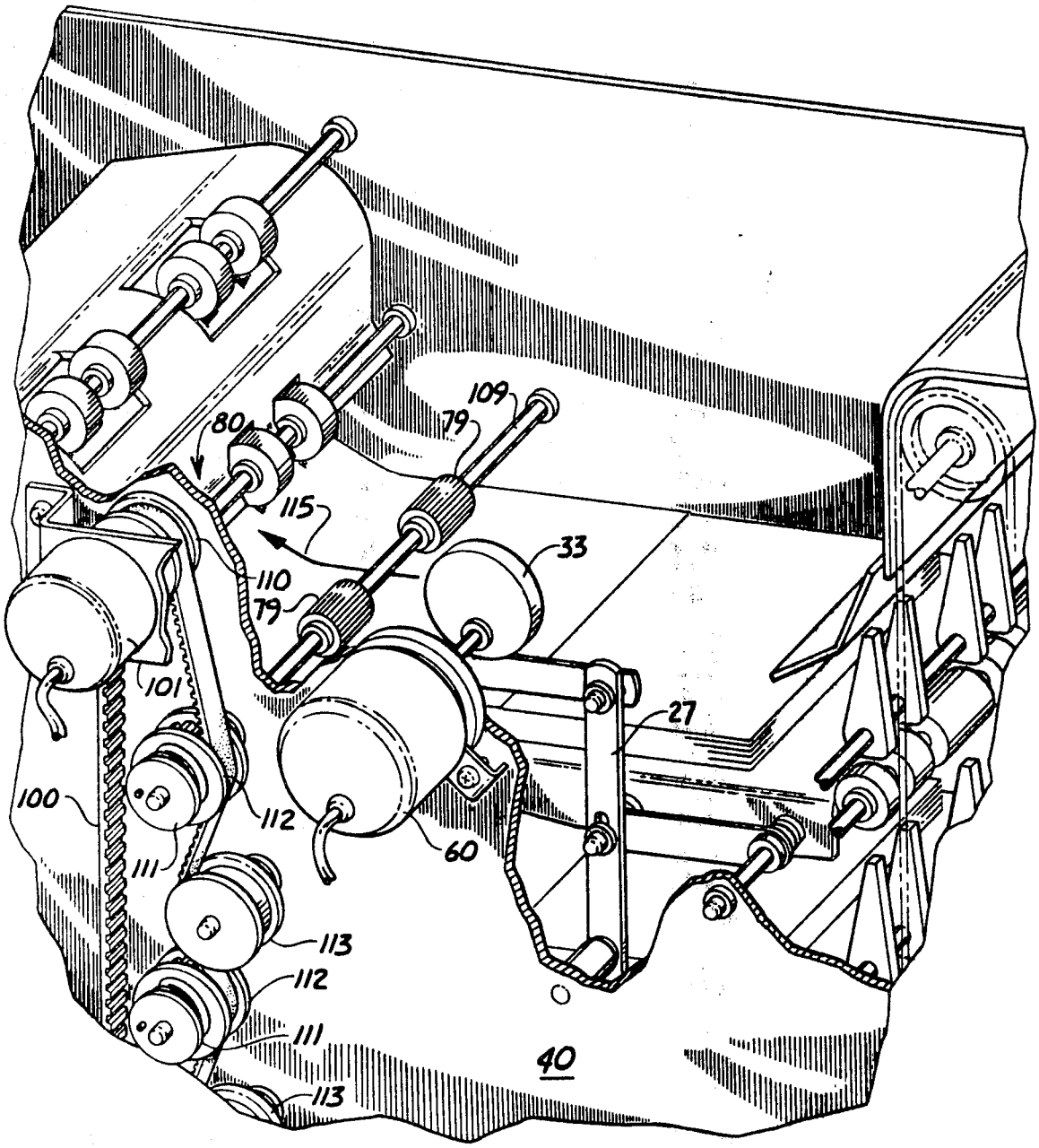
FIG. 8 is a perspective view of the ejection apparatus for the embodiments shown in FIGS. 6 and 7.

Referring to FIG. 8, the sheet ejection drive mechanism 80 for embodiments 10*a* and 10*b*, respectively, is illustrated in more detail. The drive mechanism comprises a timing belt 100, which is driven by a motor 101 via a timing pulley 110 rotatably mounted upon the collator-sorter housing 40.

Each ejection roller 79 is affixedly mounted to a shaft 109, which is secured to a timing pulley 112 via an over-running clutch 111. Each timing pulley 112 is driven by the timing belt 100. A tensioning pulley 113 is disposed between each roller pulley 112 for maintaining tension in the belt.

The over-running clutches 111 allow the sheet on each tray to be pulled (arrow 115) from the bite of the ejection rollers 79, when the sheet is engaged by the takeaway conveyor belt.

In summary, embodiments of the inventive collator-sorter have shown that the sheet ingress and egress from the receiving bins (trays) can be either from the left side or right side of the machine. In other words, there are four possibilities for the sheet flow: a) left side loading and ejecting; b) right side loading and ejecting; c) right side loading and ejecting from the left side of the machine; and d) left side loading and ejecting the sheets from the right side of the machine.

Discussion of the Control System

Before describing the control system circuitry, it will be necessary to define a few terms:

(a) "page run" or "page run cycle" is that portion of the collating or sorting operation wherein a single page, for example page 6, of a booklet is being deposited in the bin(s). For the sorting mode, each page 6 will be deposited in each respective bin selected. In the collating mode, all the pages 6 will be deposited in the sixth bin.

(b) "sheet count" is the number of sheets being counted during a page run cycle.

(c) "select count" is the number of bins or sheets that are selected to be deposited during each page run cycle.

(d) "high and low signals" are generally designated by the numbers "1" and "0", respectively. However, it is well known that the logic can easily be inverted to provided a complement of signals using low signals in place of high signals and vice versa.

FIG. 9 is an electrical schematic depicting the control logic necessary to operate the collator-sorter in either of the two modes: sorting or collating. The circuitry of FIG. 9 will be explained with reference to, and in conjunction with the collator-sorter embodiment 10*a* shown in FIG. 6. However, it should be understood that all the aforementioned embodiments can use similar control circuitry. The circuitry of FIG. 9 can be changed to accommodate the other embodiments. The changes in the circuitry necessitated by the different embodiments are easily within engineering skill, and merely require the actuation or deactuation of various other controls. The actuation or deactuation of these other controls will follow the logic pattern of the circuit illustrated in FIG. 9, as will hereinafter be explained.

Before the collator-sorter can be operated in a collating or a sorting mode, the trays 74 must be in their proper position, i.e. at the proper angle for loading or for ejecting sheet material. To accomplish this, switch 280 of FIG. 10 is depressed. The depression of switch 280 causes a power relay 281, which is supplied with power via line 290 bby the on-off switch 210, activates the motor 60. The motor 60, as will be recalled, will turn cam 33 through a half revolution (180°).

If the trays 74 are initially in the horizontal position, the depression of switch 280, will activate motor 60 to cam them into the inclined position 74' (FIG. 6).

If the trays 74 are initially in the inclined position, the depression of switch 280 will cause them to be cammed into a horizontal position.

A detector (not shown) will signal the loading and the ejecting positions, which will be indicated by either the loading indicator light 282 or the ejecting indicator light 283.

All the manual control buttons and indicator lights are located on a user panel on the front of the machine (not shown).

In a sorting mode, let us assume that there are ten bins 74 (FIG. 6), into which it is desired to feed a quantity of sheets to make ten booklets. One sheet of each page of the booklet will be deposited in sequential order into each bin, until all the pages of the booklet are received in each bin. The sheets are fed to the inlet 71 of the collasorter 10*a*. A photodetector device is located at the inlet 71. It is comprised of a light source 71*a* and a phototransistor 71*b*. A high signal is given whenever a sheet blocks the light path to the phototransistor 71*b*, such that a running sheet count may be obtained. If each one of the bins 74 is to receive a page in each run, the deflectors 73 must be sequentially operated for each run. This is achieved by the auto load/sort control logic 215 illustrated in FIGS. 9 and 9*a*. The high signal from the sheet detector 71*a*, 71*b* is transmitted to the auto load/sort control logic 215 along line 216 to input "C". The control logic 215 also receives a high signal along line 217 at input "A" from the sort/collate decoder 218. The decoder 218 has been set for the maximum number of bins, in this case ten. The decoder 218 will give a high signal for any number of sheets up to the bin maximum. In the collate mode, which will be explained hereinafter, the decoder 218 will give a low signal, signifying that more sheets than the maximum number of bins has been selected.

The sort/collate decoder 218 is comprised of a few NOR and NAND gates illustrated in FIG. 9*c*, which are designed to follow the truth table shown in FIG. 9*d*.

The decoder 218 output is the result of selecting the desired number of sheets using the copy count select thumbwheel 219 (FIG. 9). The thumbwheel 219 will furnish the input to the decoder 218 along line 220 such that the control logic 215 will receive either a high or low signal at input "A".

The thumbwheel select signal will also furnish an input to a sheet count comparator 221, whose function is to compare the "running count" of the sheets in each run with the "select count". When the two counts show an equality, it is an indication that a new "page run" should be initiated, i.e. the next page of the booklet should be fed into each bin.

However, as each bin is filling during a page run in the sort mode, it is seen that a high signal will be received at input "C" of control logic 215 every time a sheet passes the photoconductor 71*b*, and a standing high signal will be received at input "A" of control logic 215.

The control logic 215 is shown in more detail in FIG. 10*a*, and its operation will be explained with reference to the truth table in FIG. 10*b*.

The signals at inputs "A" and "C" are directed to NOR gates 222 and 223, respectively. The outputs of NOR gates 222 and 223 are fed to NOR gate 224, which supplies a signal at output "W". NOR gates 225, 226 and 227 do not produce any output signals "X", "Y" or "Z" as can be seen from the truth table of FIG. 9 on line 6.

Therefore, every time a sheet passes photodetector 71*b*, a signal will be outputted at "W". The "W" signal will be sent over line 230 to the stepper 231, which successively actuates the individual solenoids which respectively control each deflector 73.

Thus, it will be observed that every time a sheet passes photodetector 71*b* during a "page run" in the sort mode, the next deflector 73 will be activated.

It should be understood that whether the last bin 74 of the array of bins is filled first in a backwards progression (10, 9, 8, 7, etc.), or the first bins if filled first in a forward progression (1, 2, 3, 4, etc.), it will make no difference in the final result. It will make a difference, however, in whether the deflectors 73 are in an initial "up" (deflecting) position, or in a "down" (nondeflecting) position.

How the bins are to be filled, i.e., either bottom-to-top or top-to-bottom, is strictly a matter of choice. The machine 10*a* can be easily designed to operate in either or both sequential modes.

When a "page run" is completed, all the deflectors 73 must be reset by actuating a reset motor 63. (Refer to copending application, Ser. No. 790,348.). Also, the stepper control 231 of FIG. 9 must also be reset to allow for the successive actuation of each deflector solenoid. This is accomplished by means of counter 232 (FIG. 10).

When a sheet of any "page run" moves past detector 71*b*, a counter 232 which has been counting each sheet of the run, sends a signal to the comparator 221 via line 233. The counter 232 receives a signal each time a sheet passes detector 71*b*, via the "count input" OR gate 234.

The comparator receives a "select count" signal from thumbwheels 219 via line 220, and the "sheet count" signal from counter 232 via line 233. The comparator compares these two signals, and if there is an equality, will provide a high signal to input "B" of control logic 215. This condition will only take place, however, when the last sheet of every "page run" moves past detector 71*b*.

When a high signal is on all the inputs "A", "B" and "C", NOR gates 222, 228 and 223, will respectively cause output signals to be delivered by NOR gates 225, 226 and 227 (FIG. 9*a*).

Referring to the truth table of FIGS. 9*b*, line 8, high inputs "A", "B" and "C", will cause outputs at "W", "X" and "Y" of control logic 215.

The "X" output will provide a counter reset pulse to reset counter 232, via line 236. The counter 232 is reset to start counting from the beginning for the next run.

The "W" output actuates the stepper 231 to operate the last deflector solenoid.

The "Y" output provides a stepper reset pulse via line 237 to return the stepper control 231 to its home position, and to actuate motor 63 via a power relay 238. As will be seen, the "Y" reset pulse is delayed via delay 239. This delay allows for the last deflector to be set by the "W" signal, before the motor 63 clears all the deflectors, and it also allows the last sheet enough time to be deposited into the final bin (conveyor delay). Should the final bin to be filled be bin number 10, the conveyor delay will be much longer than when the final bin 74 is bin number one.

The "Y" reset pulser 240, while providing a reset pulse to line 237, will also provide a reset signal to the relay latch 241 via line 242. This will allow the next "Y" output (at the end of the next "page run") to again provide a reset pulse to line 237.

The first sheet of the next page run will now start the page run cycle all over again. There will be a series of "W" outputs to continuously step (stepper 231) the deflector solenoids, until the last page of the page run cycle initiates still another (new) page run cycle.

When it is desired to obtain more than ten booklets, the collate mode of operation for machine 10*a* will be selected. The sort mode will not accommodate this number of booklets, because there are only ten bins 74 in the present example.

Naturally, the present invention is not limited to any particular number of bins. It has been estimated, however, that the number of bins for the average user should be somewhere in the range from 10 to 15.

When the collate mode is desired (as when more booklets are needed than the number of bins available), the decoder 218) will provide a low signal to input "A" of control logic 215. The input to "B" will be low, except for the last sheet of a "page run", and the input "C" will go high with each passing of a sheet before detector 71*b*. It should be noted that for the collate mode, the "page run cycle" referred to above, now stands for the number of sheets of each page deposited into its respective bin, i.e. all of pages one in bin 10, all of pages two in bin 9, all of pages three in bin 8, etc.

Because in the collate mode, "A" is always low, the high "C" input for each sheet in a page run will provide a "Z" output (high signal on the outut of NOR Gate 227, FIG. 9*a*. This will be seen to be true, with reference to the truth table of FIG. 9*b*, line 2.

The "Z" output (FIG. 10) of the control logic will provide only one step pulse to the stepper control 231 via line 230 throughout each page run. The Normally Closed relay 243 will become latched open with the first "Z" output signal. All subsequent "Z" output signals in the page run will, therefore, provide no stepping signal to stepper control 231 via line 230 and step pulser 244.

When the last sheet of a page run is obtained, the comparator 221 will compare the "sheet count" of counter 232 with the "select count" of the selector switches 219 and will find an equality. The "B" input will go high, and the condition in line 4 of the truth table (FIG. 10*b*) will be evidenced.

An output will now obtain on "X" and "Z" of control logic 215.

The "X" output will provide a rest signal to the counter 232 via line 236, to provide for the next page run. TThe counter reset pulse, which is provided by pulser 245, also provides a pulse to reset relay 243 via line 246. Therefore, when the first sheet of the next page run provides a "Z" output, the next deflector solenoid will be actuated. This will continue until all the selected bins are filled.

Now, when the sheets are desired to be ejected in collated sets from the bins, a collate start switch 251 is depressed. Latching logic or other suitable holding circuit means 252 is activated. This collating latching logic 252 will supply a signal to power relays 212 and 295. An ON/OFF switch 210 as aformentioned causes the power supply 211 to supply power to the power relays 212, 213, 238 and 295 respectively, via line 290.

When power relays 212 and 295 receive the signal from the latching logic 252, they will activate the conveyor drive motor 253 and the eject drive motor 101, respectively. Motor 253 will drive conveyor 78, and the eject drive motor 101 will drive belt 100 (FIG. 8).

The latching logic 252 will supply still another signal to reset all the deflectors 74. This is an important control feature, because if any of the deflectors are in the "down" (non-deflecting) position when the sheets are to be loaded again into the bins in a new run, then the machine 10*a* will become jammed. The reset signal is supplied to the reset relay 256 via line 258. The reset relay 256 will supply a signal to power relay 238 to actuate the one cycle deflector reset motor 63 (FIG. 3) via lines 257 and 237.

The reset relay 256 will also reset the counter 232 via line 260. The reset relay may also be actuated by a reset switch 270 (FIG. 9).

The sort starting switch 271 (FIG. 9) wil cause the sort latching logic or holding circuit 262 to power the sort conveyor drive motor 263 via the power relay 213. The motor 263 will drive the conveyor 72.

When either the collate start switch 251 is thrown, the stop circuit 273 will provide a stop signal to the sort latching circuit 262. Conversely, when the sort start switch 271 is thrown, a stop signal will be provided by the stop circuit 273 to the collating latch circuit 252. This will insure that if the machine 9*a* is operating in, or is set for the alternate mode, the change of mode will not cause any interference to develop.

Depressing the stop switch 272 (FIG. 9) will cause the machine to cease its operation in either mode.

It is to be understood that other functions of the mnachine such as offset stacking of collations, stapling, stitching, jam and miss detection have not necessarily been shown or explained. These functions are easily within the skill of the engineer, and are not necessary for an understanding of the invention, i.e. operating machine 10*a* in either a collating or a sorting mode.

As aforementioned, the logic taught by circuit 215 (FIGS. 10 and 9*a*) can be employed with minor variations to control the other embodiments of the invention.

Naturally, many modifications will occur to the skilled practitioner consistant with the inventive purposes. Such changes are deemed to lie within the purview, limits, spirit and scope of the invention.

Having described the invention, what is desired to be protected by Letters Patent is presented by the appended claims.

What is claimed is:

1. In a combined sorting and collating machine selectively operable in a plurality of modes of operation wherein a plurality of copy sheets are assembled into booklets said machine including:

a. means defining an infeed location and an outfeed location;

b. means defining a plurality of adjacent copy sheet receiving and sorting bins operatively associated with said means defining said infeed location and said outfeed location;

c. conveyor means operatively associated with said plurality of bins for conveying copy sheets seriatim from said infeed location to said plurality of bins and for conveying copy sheets from said plurality of bins to said outfeed location;

d. means operatively associated with said plurality of bins for ejecting copy sheets from said plurality of bins to said conveyor means for delivery of said ejected copy sheets to said outfeed location in order to sequentially assemble booklets, thereby defining a collating mode of operation;

the improvement comprising:

e. a plurality of movable deflecting members each disposed adjacent a respective bin of said plurality of bins, each of said deflecting members being movable from a non-deflecting position to a deflecting position intersecting the path of travel of said copy sheets being conveyed by said conveyor means, whereby copy sheets being conveyed by said conveyor means are deflected into a respective bin of said plurality of bins, and f. means for selecting the number of booklets to be assembled from said plurality of copy sheets;

g. control means responsive to said booklet number selecting means and operatively associated said ejecting means and with said deflecting members for operating said deflecting members member in either (1) a first sequence for causing copy sheets to be deposited one by one into a predetermined number of bins when the selected number of booklets is equal or less than the number of said plurality of bins, thereby defining a machine sorting mode in which a booklet is assembled in each predermined bin, or for operating said deflecting members in (2) a second sequence for causing a number of copy sheets corresponding to said selected number of booklets to be consecutively deposited into each of a predetermined number of bins when said selected number of booklets is greater than said plurality of bins, thereby defining a loading mode of operation preparatory to said collating mode of operation.

2. In the combined sorting and collating machine of claim 1, wherein said control means further comprises:

a. a plurality of setting means, each setting means operatively connected to and setting a respective deflecting member in one of said deflecting or non-deflecting positions;

b. reset means operatively connected to all the deflecting members for resetting all the deflecting members to one of said deflecting or non-deflecting positions; and c. cycling means operatively connected to said plurality of setting means and reset means for sequentially operating each deflecting member in either said sorting or loading sequence of operation, and for resetting the deflecting members after each sequential operation of said deflecting members, thereby defining an operating cycle.

3. The combined sorting and collating machine of claim 2, further comprising:

a. a copy sheet select means for selecting the number of sheets to be sorted or loaded for subsequent collating;

b. detector means for detecting the number of copy sheets entering the infeed location;

c. counter means operatively coupled to said detector means for counting the number of sheets entering the infeed location; and d. comparator means operatively coupled to said counter means and said copy sheet select means for comparing the selected number of copy sheets with the number of sheets counted entering the infeed location, and for feeding a signal to said cycling means indicative of when there is an equality between said select count and said sheet count thereby indicatiing the completion of an operating cycle.

4. The combined sorting and collating machine of claim 2, wherein said setting means comprises a stepper operatively connected to each deflecting member for stepping each deflecting member to one of said deflecting positions in a sequential order.

5. The combined sorting and collating machine of claim 4, wherein said setting means comprises a plurality of solenoid controls, each solenoid control connected to said stepper and to a respective deflecting member.

* * * * *